US006433263B1

(12) United States Patent
Hogue

(10) Patent No.: US 6,433,263 B1
(45) **Date of Patent: *Aug. 13, 2002**

(54) SUPPORTING THE SOUND BOX OF A STRINGED INSTRUMENT WITH RODS

(76) Inventor: John H. Hogue, 6051 Sierra Pass, Flint, MI (US) 48532

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/876,226

(22) Filed: Jun. 16, 1997

(51) Int. Cl.[7] ..... G10D 1/02
(52) U.S. Cl. ..... 84/276; 84/275; 84/291
(58) Field of Search ..... 84/275, 276, 291

(56) References Cited

U.S. PATENT DOCUMENTS 1,426,852 A * 8/1922 Frozeth ..... 84/275
2,020,557 A * 11/1935 Loar ..... 84/726

* cited by examiner

*Primary Examiner*—Shih-Yung Hsieh
(74) *Attorney, Agent, or Firm*—Brooks & Kushman, P.C.

(57) ABSTRACT

A method to relieve the pressure on the top, bottom, and sides of a stringed musical instrument by securing two wooden rods between the neck block and the tail block, with the rods positioned lower at the tail block than at the neck block. The rods are tapped and tuned by selectively removing material from the rods to achieve the desired tone and to eliminate sound wave clash. This method will allow more different types of material to be used in the construction of musical instruments with more powerful and improved tone quality.

9 Claims, 1 Drawing Sheet

SUPPORTING THE SOUND BOX OF A STRINGED INSTRUMENT WITH RODS

FIELD OF THE INVENTION

The present invention relates to a method of supporting a sound box or board of a stringed musical instrument or boards by attaching free floating rods or dowels to the neck block and tail block. If the rods are counter sunk, they are called dowels. If more than one rod is used, a and the rods are not attached together, they should be tuned to different notes.

BACKGROUND OF THE INVENTION

Musical instruments, such as guitars, have many pounds of pressure on their tops, sides and back when the strings are tuned. The makers of stringed musical instruments added lining top supports and end blocks many years ago. Sixty years ago they added neck rods to keep the necks from bowing. In the mid 1950's they developed the solid body steel guitar. This invention carries the art of building musical instruments a step further, eliminating many of the problems associated with the manufacturing of stringed musical instruments.

DESCRIPTION OF THE PRIOR ART

U.S. Pat. No. 485,651 issued to Perry in November 1892.

U.S. Pat. No. 3,122,960 issued to Stuhlem in March, 1964.

U.S. Pat. No. 3,884,109 issued to Johnson in May, 1975.

U.S. Pat. No. 4,373,980 issued to Skelmwierski in February 1983.

U.S. Pat. No. 4,407,181 issued to Thomas in October, 1983.

U.S. Pat. No. 4,941,383 issued to Hogue in July 1990.

U.S. Pat. No. 5,025,694 issued to Hogue in June 1991.

U.S. Pat. No. 5,103,707 issued to Hogue in April 1992.

U.S. Pat. No. 1,367,580 issued to Ashley.

U.S. Pat. No. 2,020,557 issues to Loar.

Austrian patent 58,478 issued in April 1913.

United Kingdom patent 27,605 issued December 1908.

United Kingdom patent 433,422 issued August 1935.

SUMMARY OF THE INVENTION

The broad purpose of this invention is to simplify the construction of guitars and musical instruments. This invention will also give the instruments more power and tone quality. This invention makes possible the use of more and different types of materials to form the sound boxes or sound boards. This invention works on new and old instruments.

DETAILED DESCRIPTION OF THE PREFERRED EMBODIMENTS

Figure 2:
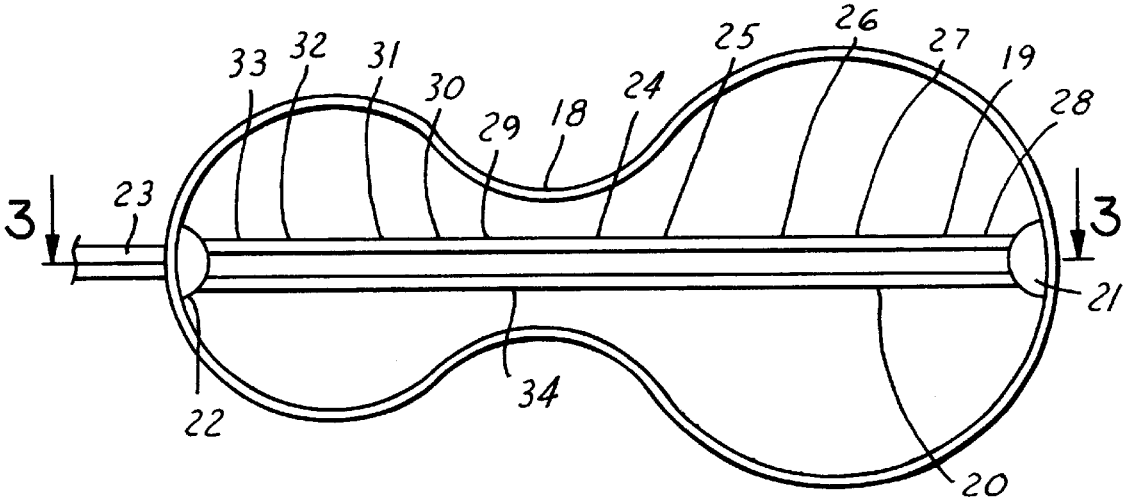
FIG. 2 is a view of the inside of a flat top guitar wit the top removed. The two rods run from the tail block to the neck block. If the rods are counter sunk at the neck block and tail block they are called dowels.

Guitars and other stringed instruments have many supports glued to their top in the prior art. If the supports that are used at present are eliminated and replaced with one or a plural number of rods or dowels, a big problem in guitar building will be virtually eliminated. As shown in FIG. 2, the rods are preferably secured to the neck block and to the tail block in spaced, parallel relation. The rods or dowels are not supported between the neck block and the tail block, to allow them to vibrate freely to produce their own sound wave to complement the sound waves that are produced by the top, sides and back of the instrument.

An instrument maker will have no problem understanding this invention and picking the right size rods or dowels and the method to attach the rods or dowels to the neck block and tail block. Glue is typically used to secure the rods to the neck block and to the tail block. Steel rods are recommended for steel, and the rods are secured to the neck block and the tail block by brazing or welding graphite or other material. Use what is recommended.

If the rods are counter sunk in the neck block and tail block they are called dowels. Another embodiment related to tuning the rods or dowels, which is the simplest part of making the instrument, is to use a small vise or clamp with wooden jaws. Clamp one end of the rod in the clamping device, and start at the other end and tap the rod every two inches lightly (+–). A very faint tone (or note) will be heard if the top of the instrument is tuned to E and the back of the instrument is tuned to D. Then tune the dowel to another note. For lower notes, select a lower pitch tone; for higher notes, select a higher pitch tone.

It is much easier to take material off than to add material on to a dowel or rod. When the rod or dowel has been tuned every two inches down to the clamp, reverse ends of the dowel or rod and repeat the process.

Figure 3:
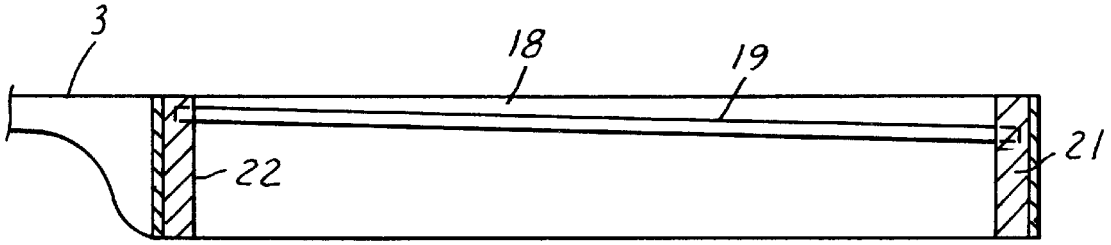
FIG. 3 shows the rods and dowels placed a few degrees lower at the tail block than at the head block to help prevent sound wave clash. Note that the rods and dowels are secured at the head block and the tail block, but are not secured therebetween to improve tone quality.

Another way to tune the rod, is to determine the size of the rod by looking at the size of the material used in the prior art. On a guitar, glue the wooden rod to the neck block and tail block near the top at the neck block and slope the rod approximately ⅜ of an inch (+–) lower at the tail block as shown in FIG. 3 to avoid sound wave clash. Different instruments may require different angles of slope on the rods or dowels. With the rods glued to the neck block and tail block, start at the center point of the rod and work to the tail block and back to the neck block, tapping about every two inches. After the rod has been tuned, tap any place on the rod and it will sound the same note it was tuned to. A knuckle or forefinger may be used to flick the rod (same as picking a guitar string) or tapping it.

When two rods are used, the rod on the little E side of the guitar will have more pressure on it Therefore, make this rod larger and tune it to a higher note than the rod on the big E side of the guitar. The thicker the back, sides and top of a guitar, the smaller the rods, and the pitch or voice of the guitar will be higher. Less wood in the top, sides and back will require a larger rod, and the pitch will be lower.

For hand made instruments, gluing the rod to the neck block and tail block will be the easiest way to tune the rods. For production instruments, secure a small vice or clamp at each end of the rod, and tap every two inches plus or minus, until the entire rod is tuned. The rod should be tuned slightly flat at the neck and tail blocks, with the top glued on, and the strings tuned. There will be slightly more pressure where the rods are attached. If four smaller rods are built into a trussel and tuned to a lower note, the guitar will produce a lower tone, as compared to a large rod. With untuned rods or dowels, the tone of a guitar will improve naturally. With the tuning of the rods or dowels, the tone of the guitar will improve much more.

Figure 1:
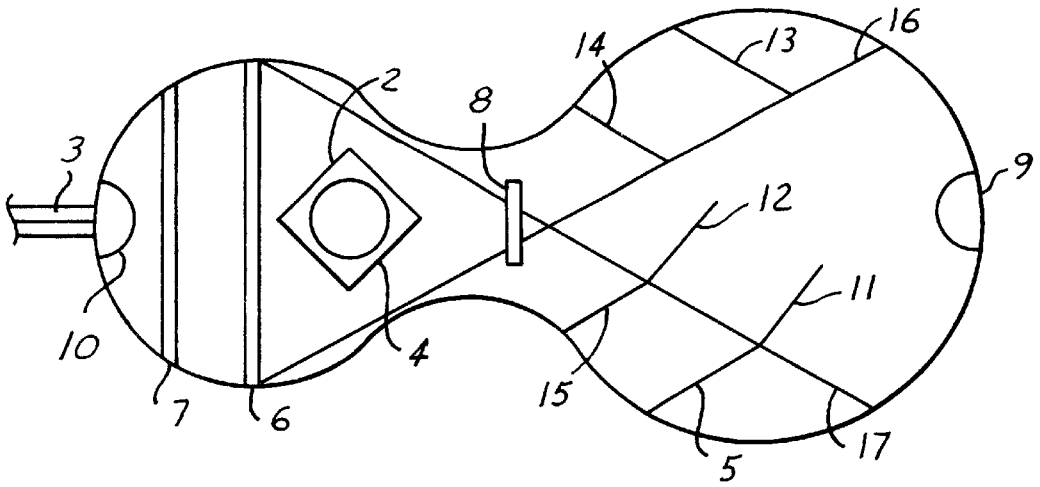
(PRIOR ART) FIG. 1
FIG. 1 is a view of a prior art flat top guitar with the back off looking down, with all the bars glued to the top. Wood bars and braces glued in this configuration is the standard way of building flat top guitars today.

Referring to FIG. 1, the top of a prior art flat top guitar is shown, with the supports and braces attached. The sound hole support 2, the neck 3, the sound hole 4, the right rear support 5, the front support 6, the front and neck block supports 7, the bridge support 8, the tail block 9, the neck block 10, the rear center support 11, the middle center support 12, the left side support 13, the left center support 14, the right middle support 15, the first main support 16, and the second main support 17 are shown.

FIG. 2 shows the inside of a guitar with the back and top not glued on. The sides 18, front and back form the sound chamber. The little E support rod 19, the big E support rod 20, the tail block 21, the neck block 22, and the neck 23 are also shown in FIG. 2. The mid-point starting position 24 to tap for the desired note is shown . The second tapping position is 25, the third tapping position is 26, the fourth tapping position is 27, the fifth tapping position is 28. Continue tapping and tuning toward the neck 29, towards the second position 30, the third position 31, the fourth position 32, the fifth position 33, etc. Start at position 34 for the big E support rod 20, and repeat all the tapping positions 25–33 shown for the little E support rod 19.

FIG. 3 shows the rod or dowel secured to the neck block 22 and to the tail block 21. Note that the rod or dowel is not secured between the neck block 22 and the tail block 21, to allow the rod or dowel to vibrate freely between the neck block 22 and the tail block 21, to produce their own sound wave pattern to complement the sound waves that are produced by the top, sides and back of the instrument. Note also that the dowel or rod is inclined or sloped downwardly from the neck block 22 about ⅜ of an inch towards the tail block 21 to avoid sound wave clash. Different instruments may require different angles of incline or slope on the rods or dowels to obtain the desired results.

With the rods glued to the neck block and tail block, start at the center point of the rod and work to the tail and back to the neck, tapping about every two inches. After the rod has been tuned, tap any place on the rod and it will sound the same note it was tuned to. A knuckle or forefinger may be used to flick the rod (same as picking a guitar string) or tapping it.

When two rods are used, the rod on the little E side of the guitar will have more pressure on it. Therefore, make this rod larger, and tune to a higher note than the rod on the big E side of the guitar. The thicker the back, sides and top of a guitar, the smaller the rods and the pitch or voice of the guitar will be higher. Less wood in the top, sides and back will take a larger rod and the pitch will be lower.

For hand made instruments, gluing the rod to the neck block and tail block will be the easiest way to tune the rods. For production instruments, secure a small vice or clamp at each end of the rod and tap about every two inches plus or minus until the entire rod is tuned. The rod should be tuned slightly flat at the neck and tail blocks, with the top glued on and the strings tuned. There will be slightly more pressure where the rods are attached. If four smaller rods are built into a trussel and tuned to a lower note, the guitar will produce a lower tone as compared to a large rod. With untuned rods or dowels, the tone of a guitar will improve, and with tuning rods or dowels, the tone will improve much more.

It is understood that the present invention is not limited to the sole embodiments described above, but encompasses any and all embodiments within the scope of the following claims.

I claim:

1. A method to support a sound box having a neck block and a tail block of a stringed musical instrument, comprising the steps of:

a) securing at least two rods at one end to the neck block;

b) securing said at least two rods at the opposite end to the tail block a few degrees lower than the neck block;

c) tuning the stringed musical instrument by selectively removing material from said rods, thus reducing the pressure on the sound box of the stringed musical instrument to improve the tone quality and reducing the sound wave clash.

2. The method of claim 1, wherein the rods are wooden rods positioned in spaced, parallel alignment.

3. The method of claim 1, wherein securing the rods at said first end to the neck block and at said second end to the tail block while the rods are not supported between the neck block and the tail block.

4. The method of claim 1, wherein said at least two rods comprises sizing the rods to be of different sizes, with the smaller rod tuned to a higher note.

5. The method of claim 1, wherein securing the rods to the neck block and the tail block comprises using a strong commercial glue.

6. A method to improve the tone quality of a stringed musical instrument having a neck block and a tail block, comprising the steps of:

a) securing a first wooden rod and a second wooden rod in spaced parallel alignment at one end to the neck block, and at the opposite end to the tail block, with the rods positioned several degrees lower at the tail block than at the neck block;

b) tapping the first rod at midpoint and moving towards the neck block and selectively removing material as needed to obtain a desired sound, and tapping the first rod at midpoint and moving towards the tail block and selectively removing material as needed to obtain a desired sound; and c) tapping the second rod at midpoint and moving towards the neck block and selectively removing material as needed to obtain a desired sound, and tapping the second rod at midpoint and moving towards the tail block and selectively removing material as needed to obtain a desired sound.

7. The method of claim 6, wherein securing the rods to the neck block and the tail block while the rods are not supported between the neck and the tail block.

8. The method of claim 6, wherein sizing the first rod to be smaller in size than the second rod, and tuning the first rod to a higher note than the second rod.

9. The method of claim 6, wherein securing the rods to the neck block and the tail block, comprises using a strong commercial glue.

* * * * *